US005632326A

United States Patent [19]

Gough

[11] Patent Number: 5,632,326

[45] Date of Patent: May 27, 1997

[54] MOULD AND A METHOD FOR THE CASTING OF METALS AND REFRACTORY COMPOSITIONS FOR USE THEREIN

[75] Inventor: Michael J. Gough, Gnosall, England

[73] Assignee: Foseco International Limited, Birmingham, England

[21] Appl. No.: 532,633

[22] PCT Filed: Apr. 8, 1994

[86] PCT No.: PCT/GB94/00750

§ 371 Date: Nov. 28, 1995

§ 102(e) Date: Nov. 28, 1995

[87] PCT Pub. No.: WO94/23865

PCT Pub. Date: Oct. 22, 1994

[30] Foreign Application Priority Data

Apr. 22, 1993 [GB] United Kingdom ..... 9308363

[51] Int. Cl.[6] ..... B22C 1/00

[52] U.S. Cl. ..... 164/529; 501/80; 164/53; 164/359

[58] Field of Search ..... 164/529, 359, 164/53, 54, 360; 501/80

[56] References Cited

U.S. PATENT DOCUMENTS

| | | | |
|---|---|---|---|
| 3,198,640 | 8/1965 | Walsh | 164/53 |
| 4,687,752 | 8/1987 | Peters . | |

FOREIGN PATENT DOCUMENTS

| | | | |
|---|---|---|---|
| 399727 | 5/1990 | European Pat. Off. . | |
| 2057788 | 5/1971 | Germany | 164/53 |
| 2121353 | 11/1972 | Germany . | |
| 4-144981 | 5/1992 | Japan . | |
| 876261 | 10/1981 | U.S.S.R. . | |
| 1435374 | 11/1988 | U.S.S.R. . | |
| 627678 | 8/1949 | United Kingdom . | |
| 774491 | 5/1957 | United Kingdom . | |
| 889484 | 2/1962 | United Kingdom . | |
| 939541 | 10/1963 | United Kingdom . | |
| 1204472 | 9/1970 | United Kingdom . | |
| 1279096 | 6/1972 | United Kingdom . | |
| 1283692 | 8/1972 | United Kingdom . | |
| 1448320 | 9/1976 | United Kingdom . | |
| 1495698 | 12/1977 | United Kingdom . | |
| 2001658 | 7/1978 | United Kingdom . | |

*Primary Examiner*—Kuang Y. Lin
*Attorney, Agent, or Firm*—Nixon & Vanderhye P.C.

[57] ABSTRACT

A mold for metal casting contains a bonded refractory composition comprising hollow alumina-containing microspheres in which the alumina content is at least 40% by weight. The mold may be an ingot mold and the bonded refractory composition may be in the form of a sleeve or boards located in the top of the mold or in the head box thereto. The mold may be a sand mold and the bonded refractory composition may be in the form of a sleeve or boards located in a feeder cavity or in the form of a board or pad located so as to constitute a metal casting surface where it is desired to promote directional solidification in cast metal. The bonded refractory composition may also be in the form of a breaker core. In a preferred composition the microspheres contain alumina and silica and the composition may also contain one or more other particulate refractory materials, a readily oxidizable metal, an oxidizing metal, an oxidizing agent for the metal and a fluoride salt.

20 Claims, No Drawings

MOULD AND A METHOD FOR THE CASTING OF METALS AND REFRACTORY COMPOSITIONS FOR USE THEREIN

This invention relates to a mould and a method for the casting of metals, and particularly for the casting of steel, and to refractory compositions for use therein.

When molten metal is cast into a mould and allowed to solidify the metal shrinks during solidification. In order to compensate for this shrinkage and to ensure that a sound casting is produced it is usually necessary to employ so-called feeders located above and/or at the side of the casting. When the casting solidifies and shrinks molten metal is fed from the feeder(s) into the casting and prevents the formation of shrinkage cavities. In order to improve the feeding effect and to enable the feeder volume to be reduced to a minimum it is common practice to surround the feeder cavity and hence the feeder itself with a refractory exothermic and/or heat-insulating material which retains the feeder metal in the molten state for as long as possible.

For the same reason it is also common practice in the casting of ingots, for example steel ingots, to line the head of an ingot mould or head box fitted to an ingot mould with a refractory exothermic and/or heat-insulating composition.

In both applications the refractory exothermic and/or heat-insulating compositions are used in the form of preformed shapes such as cylindrical sleeves for lining the feeders of foundry casting moulds and boards for the lining of ingot mould heads or head boxes.

The exothermic compositions employed in the applications described above usually consist essentially of a metal which is readily capable of oxidation, usually aluminium, and an oxidising agent therefor, for example iron oxide, sodium nitrate or manganese dioxide. The composition will usually contain a particulate refractory filler, and a binder to bond the composition into a preformed shape. Preformed shapes which are to heat-insulating as well as exothermic will usually contain a fibrous material and/or a light-weight particulate refractory material.

In order to improve the sensitivity, of the exothermic composition, i.e. reduce the time lag between applying to the composition a temperature at which it will ignite and the actual ignition of the composition, it was proposed some years ago to include in the composition a proportion of an inorganic fluoride salt. Examples of inorganic fluoride salts which may be used for this purpose include simple fluorides such as sodium fluoride or magnesium fluoride, and complex fluorides such as sodium silicofluoride, potassium silicofluoride, sodium aluminium fluoride or potassium aluminium fluoride. Exothermic compositions containing inorganic fluoride salts are described in British Patents 627678, 774491, 889484 and 939541.

Non-exothermic refractory compositions usually consist of particulate refractory material, inorganic and/or organic fibres and a binder.

In both types of composition the particulate refractory material used is commonly alumina, Silica or an aluminosilicate, and aluminosilicate fibres are commonly used as the fibrous component of compositions which are to be used for the casting of steel.

When refractory compositions which are to be used in the form of sleeves for feeding steel castings contain both alumina and silica, it has been found in practice that the quantity of alumina present in the composition expressed as a percentage of the total of alumina plus silica should be at least about 55% by weight in the case of a heat insulating composition and at least about 70% by weight when the composition is an exothermic composition containing a fluoride.

Fibres are incorporated in exothermic and heat-insulating compositions, and in heat-insulating compositions in order to reduce the density of the compositions and to improve their heat-insulation properties and hence, their performance in feeding metal castings or ingots. Such compositions are usually formed to shape, for example, as sleeves or boards, by a method which involves forming a slurry of the components of the composition in water and sucking or forcing the slurry on to a pervious former of appropriate shape whereby the water passes through the former and the slurry solids are deposited on the former to form a coherent mass of the desired shape. The formed shape is then stripped from the former and dried to produce a usable shape. This method of manufacture is described in detail in British Patent 1204472.

Since such a method produces effluent water which can be contaminated with chemicals and other materials and since the use of fibres in compositions used for feeding in metal casting may possibly pose health hazards, it would be desirable for environmental reasons, to omit the fibres and to manufacture sleeves, boards etc., by a different method which does not produce an effluent.

In order to achieve acceptable heat-insulation properties and satisfactory performance as a feeding composition, it is necessary to replace the fibres with an alternative low density material of adequate refractoriness, particularly when the composition is to be used in the casting of steel.

It has now been found that shaped bodies in the form of, for example, sleeves or boards, for use in the feeding of castings or ingots, and in particular steel castings or ingots, can be produced using hollow alumina- and silica-containing microspheres in which the alumina content is at least about 40% by weight.

According to the invention there is provided a bonded refractory composition comprising hollow microspheres containing alumina and silica and having an alumina content of at least 40% by weight and a binder.

According to a further feature of the invention there is provided a mould for metal casting having therein a bonded refractory composition comprising hollow microspheres containing alumina and silica and having an alumina content of at least 40% by weight and a binder.

According to a further feature of the invention there is provided a method for the production of a casting in a mould, the method comprising locating in the mould cavity or in a head box or feeder cavity thereto, a bonded refractory composition comprising hollow microspheres containing alumina and silica and having an alumina content of at least 40% by weight and a binder, pouring molten metal into the mould so as to fill the mould and, if present, the head box or feeder cavity with molten metal and allowing the molten metal to solidify.

The bonded refractory composition which may be, for example, in the form of a sleeve or boards, may be located, for example, in the top of an ingot mould or in a feeder cavity of a metal casting sand mould. Alternatively, the feeding material may be used as a so-called padding material in a sand mould. In that application the material is used in the form of a board or pad to constitute the metal contacting surface of the sand mould at a location where it is desired to promote directional solidification in metal cast into the mould.

In addition to being used to form sleeves for lining feeder cavities in metal casting moulds, the bonded refractory compositions of the invention may also be used to produce breaker cores. A breaker core, which is usually in the form of a disc shaped body having a central aperture, is located at the base of a feeder sleeve and may be formed integrally with the feeder sleeve or fixed to the base of the feeder sleeve. The breaker core reduces the contact area between the feeder and the casting and provides a neck which facilitates removal of the feeder from the casting after solidification.

Hollow microspheres containing alumina and silica, in which the alumina content is at least about 40% by weight, can be used to produce feeding compositions suitable for use over a wide rage of casting temperatures and which are, therefore, suitable for use with non-ferrous metals, for example, aluminium and with ferrous metals such as iron or steel.

It is known to use fly ash floaters or cenospheres in compositions which are used for feeding but these compositions have temperature limitations and are unsuitable for use in the casting of steel. Fly ash floaters or cenospheres are hollow microspheres having a diameter of the order of 20 to 200 microns and usually contain by weight 55 to 61% silica, 26 to 30% alumina, 4 to 10% calcium oxide, 1 to 2% magnesium oxide and 0.5 to 4% sodium oxide/potassium oxide.

Suitable hollow alumina- and silica-containing microspheres for use in the compositions of the invention are available commercially from the PQ Corporation under the trade mark EXTENDOSPHERES, for example, EXTENDOSPHERES SLG, which have a particle size of 10 to 300 microns diameter and contain 55% by weight silica, 43.3% by weight alumina, 0.5% by weight iron oxide (as $Fe_2O_3$) and 1.7% by weight titanium dioxide.

In addition to the hollow alumina-containing microspheres the compositions of the invention may also contain other particulate refractory materials for example alumina, silica, alummosilicates such as grog or chamotte or coke.

The compositions may also contain a readily oxidisable metal, an oxidising agent for the metal, and a fluoride salt so that compositions are both exothermic and heat-insulating in use.

The readily oxidisable metal may be for example aluminium, magnesium or silicon, or an alloy containing a major proportion of one or more of these metals. Aluminium or an aluminium alloy is preferred. The oxidising agent may be for example iron oxide, manganese dioxde, sodium nitrate, potassium nitrate, sodium chlorate or potassium chlorate. Two or more oxidising agents may be used in combination if desired. Examples of suitable fluoride salts include simple fluorides such as sodium fluoride or magnesium fluoride and complex fluorides such as sodium silicofluoride, potassium silicofluoride, sodium aluminium fluoride or potassium aluminium fluoride.

Although such compositions are less preferred the compositions of the invention can also include a proportion of fibres such as aluminosilicate fibres or calcium silicate fibres.

Examples of suitable binders include resins such as phenol-formaldehyde resin, urea-formaldehyde resin or an acrylic resin, gums such as gum arabic, sulphite lye, a carbohydrate such as sugar or starch, or a colloidal oxide such as silica derived from colloidal silica sol. Two or more binders may be used in combination if desired.

The compositions of the invention may be formed to shape, for example as sleeves or boards, by methods such as hand or mechanically ramming the mixed components in a suitable mould or by blowing or shooting the mixed components into a mould.

The following examples will serve to illustrate the invention:

EXAMPLE 1

Three exothermic sleeves were prepared from the following compositions by weight:

| | 1 | 2 | 3 |
|---|---|---|---|
| Aluminium foil | 12.0 | 12.0 | 12.0 |
| Aluminium blown powder | 12.0 | 12.0 | 17.0 |
| Millscale (iron okde) | 10.0 | 10.0 | 10.0 |
| Manganese dioxide | 3.0 | 3.0 | 2.0 |
| Potassium aluminium fluoride | 5.0 | 5.0 | 5.0 |
| Phenol-formaldehyde resin | 10.5 | 10.0 | 6.0 |
| Urea-formaldehyde resin | 1.0 | 1.0 | 1.5 |
| Starch | 0.5 | 0.5 | 0.5 |
| Fly ash floaters (FILLITE) | 46.0 | — | — |
| Hollow alumina microspheres | — | 46.5 | — |
| Hollow alumina-silica microspheres (EXTENDOSPHERES SLG) | — | — | 46.0 |

The sleeves were blind cylindrical sleeves (i.e. they were closed at their top end apart from a vent to the atmosphere) and had a Williams core in the form of a wedge formed integrally with the top cover and extending across the inside of the sleeve. The sleeves had an internal diameter of 100 mm and an external height of 130 mm. They were produced by hand-ramming the mixed components into a mould.

Each sleeve was then used to surround the feeder cavity for a top fed bottom run mould for a 150 mm×150 mm×150 mm cube steel casting made in carbon dioxide gassed sodium silicate bonded silica sand. Plain carbon steel of nominal carbon content 0.25% which had been deoxidised using aluminum was cast into the moulds at a temperature of 1600° C.=10° C. until the level of the molten steel reached the top of the vent in the sleeve. After casting the castings were stripped from the moulds and the castings complete with the feeders were sectioned.

The following data was recorded for each of the tests:

| | 1 | 2 | 3 |
|---|---|---|---|
| Sleeve weight | 488.3 g | 502.2 g | 530.0 g |
| Macro feed % | +20 mm | +15 mm | +23 mm |
| Riser skin height | 114 mm | 115 mm | 114 mm |
| Sleeve dilation | 1 mm | zero | zero |

The sleeve diliation is determined by subtracting the internal diameter of the sleeve before casting from the diameter of the feeder at the base of the feeder and is a measure of the refractoriness of the sleeve composition. The results show that even with the small castings and feeders used in the tests where ferrostatic pressure was relatively low the composition containing the fly ash floaters is unsatisfactory while the compositions containing the hollow alumina microspheres and the EXTENDOSPHERES SLG hollow alumina/silica microspheres both gave zero dilation.

As has been stated earlier it is generally considered that for use in the feeding of steel castings the alumina content of an exothermic feeding composition containing a fluoride expressed as a percentage of the total of alumina and silica should be at least about 70% by weight.

The alumina content expressed in that manner for the fly ash floaters used in composition 1 is approximately 32 to 33% as determined from the compositional information provided by the supplier so the unsatisfactory result was to be predicted. Surprisingly however, although the alumina content of the EXTENDOSPHERES SLG microspheres is only approximately 44% when expressed as a total of the alumina and the silica in the composition, composition 3 performed identically to composition 2 containing pure alumina microspheres.

On each of the three castings the ring-shaped area which was present on the top of the casting adjacent the feeder and which had been in contact with the base of the sleeve was examined. The surface of the ring on the casting produced using composition 1 was poor due to the inadequate refractoriness of the composition while the surface of the rings on the other two castings was smooth.

EXAMPLE 2

Both compositions 1 and 3 of Example 1 were used to produce six open cylindrical sleeves having a nominal internal diameter of 150 mm, a nominal height of 150 mm and a nominal wall thickness of 20 mm.

The six sleeves were moulded one on top of the other over a block casting mould of dimensions 260 mm×240 mm×75 mm in carbon dioxide gassed sodium silicate bonded silica sand. Plain carbon steel of the type used in Example 1 was poured into the top sleeve in each case at 1600° C.±10° C. so as to fill the block casting mould and all six sleeves. 150 g of antipiping compound (Foseco FERRUX 707) was used to cover the surface of the steel. Both castings were allowed to solidify, removed from the mould and shot blasted.

The castings were then measured and inspected and the following data was recorded:

| | 1 | 3 |
|---|---|---|
| Total sleeve height | 900 mm | 900 mm |
| Casting height | 867 mm | 895 mm |
| Reduction in height due to dilation | 35 mm | 5 mm |
| Internal sleeve diameter | 148 mm | 148 mm |
| Diameter casting at base | 157 mm | 148 mm |
| Dilation | +9 mm | nil |
| Surface finish | rough | smooth |

The ring-shaped area on the block casting which had been in contact with the base of the bottom sleeve was also examined. The surface on the casting produced using composition 1 was rough while the surface on the casting using composition 3 was smooth.

EXAMPLE 3

A heat-insulating sleeve of the type described in Example 1 was prepared from the following composition 4 by hand ramming:

| | 4 |
|---|---|
| Colloidal silica sol (30% by wt solids) | 19.0 |
| Starch | 0.7 |
| Acrylic resin (Dussek Campbell E1861) | 7.3 |
| Hollow alumina-silica microspheres (EXTENDOSPHERES SLG) | 73.0 |

The sleeve was tested in the manner described in Example 1 in comparison with the same sized sleeve of an alumina/alumino-silicate fibre based composition of the type described in British Patent 283692 and which is widely used in the industry for feeding steel castings.

Both sleeves gave virtually identical results in terms of feed characteristics and dilation even though the alumina content of the sleeve made from composition 4 expressed as a percentage of the total of alumina plus silica was only 40.8% compared to 57.5% for the comparison sleeve.

We claim:

1. A bonded refractory composition comprising hollow alumina- and silica-containing microspheres, and a binder, and wherein the microspheres have an alumina content of at least 40% by weight, and the quantity of alumina present in the composition expressed as a percentage of the total alumina plus silica is less than about 55% by weight.

2. A bonded refractory composition according to claim 1 wherein the composition also contains one or more other particulate refractory materials in addition to the hollow microspheres.

3. A bonded refractory composition according to claim 1 wherein the binder is phenol-formaldehyde resin, urea-formaldehyde resin, an acrylic resin, a gum, sulphite lye, a carbohydrate or a colloidal oxide.

4. A bonded refractory composition comprising hollow alumina- and silica-containing microspheres, a readily oxidizable metal, an oxidizing agent for the metal, a fluoride salt, and a binder, and wherein the microspheres have an alumina content of at least 40% by weight and the quantity of alumina present in the composition expressed as a percentage of the total alumina plus silica is less than about 70% by weight.

5. A bonded refractory composition according to claim 4 wherein the composition contains one or more other particulate refractory materials in addition to the hollow microspheres.

6. A bonded refractory composition according to claim 4 wherein the binder is phenol-formaldehyde resin, urea-formaldehyde resin, an acrylic resin, a gum, sulphite lye, a carbohydrate or a colloidal oxide.

7. A mold for metal casting having therein a bonded refractory composition comprising hollow alumina- and silica-containing microspheres and a binder, and wherein the microspheres have an alumina content of at least 40% by weight and the quantity of alumina present in the composition expressed as a percentage of the total alumina plus silica is less than about 55% by weight.

8. A mold according to claim 7 wherein the mold is an ingot mold and the bonded refractory composition is in the form of a sleeve or boards and is located in the top of the ingot mold or in a head box thereto.

9. A mold according to claim 7 wherein the mold is a sand mold and the bonded refractory composition is in the form of a sleeve or boards and is located in a feeder cavity of the mold.

10. A mold according to claim 7 wherein the mold is a sand mold and the bonded refractory composition is in the form of a board or pad and is located so as to constitute a metal contacting surface where it is desired to promote directional solidification in metal cast into the mold.

11. A mold according to claim 7 wherein the bonded refractory composition is in the form of a breaker core located at the base of a feeder sleeve.

12. A mold for metal casting having therein a bonded refractory composition comprising hollow alumina- and silica-containing microspheres, a readily oxidizable metal, an oxidizing agent for the metal, a fluoride salt and a binder, and wherein the microspheres have an alumina content of at least 40% by weight and the quantity of alumina present in the composition expressed as a percentage of the total alumina plus silica is less than about 70% by weight.

13. A mold according to claim 12 wherein the mold is an ingot mold and the bonded refractory composition is in the form of a sleeve or boards and is located in the top of the ingot mold or in a head box thereto.

14. A mold according to claim 12 wherein the mold is a sand mold and the bonded refractory composition is in the form of a sleeve or boards and is located in a feeder cavity of the mold.

15. A mold according to claim 12 wherein the mold is a sand mold and the bonded refractory composition is in the form of a board or pad and is located so as to constitute a metal contacting surface where it is desired to promote directional solidification in metal cast into the mold.

16. A mold according to claim 12 wherein the bonded refractory composition is in the form of a breaker core located at the base of a feeder sleeve.

17. A method of producing a casting in a mold having a mold cavity, comprising the steps of:

(a) locating in operative association with the mold cavity a bonded refractory composition comprising hollow alumina- and silica-containing microspheres, and a binder, wherein the microspheres have an alumina content of at least 40% by weight, and the quantity of alumina present in the composition expressed as a percentage of the total alumina plus silica is less than about 55% by weight;

(b) pouring molten metal into the mold so as to fill the mold cavity; and (c) allowing the molten metal to solidify.

18. A method according to claim 17 wherein the mold cavity includes a head box or feeder cavity thereto, and wherein step (a) is practiced by locating the refractory composition in the head box or feeder cavity, and wherein step (b) is practiced by pouring the molten metal so that it also fills the head box or feeder cavity.

19. A method of producing a casting in a mold having a mold cavity, comprising the steps of:

(a) locating in operative association with the mold cavity a bonded refractory composition comprising hollow alumina- and silica-containing microspheres, a readily oxidizable metal, an oxidizing agent for the metal, a fluoride salt and a binder, the microspheres have an alumina content of at least 40% by weight and the quantity of alumina present in the composition expressed as a percentage of the total alumina plus silica is less than about 70% by weight;

(b) pouring molten metal into the mold so as to fill the mold cavity; and (c) allowing the molten metal to solidify.

20. A method according to claim 19 wherein the mold cavity includes a head box or feeder cavity thereto, and wherein step (a) is practiced by locating the refractory composition in the head box or feeder cavity, and wherein step (b) is practiced by pouring the molten metal so that it also fills the head box or feeder cavity.

* * * * *

UNITED STATES PATENT AND TRADEMARK OFFICE

CERTIFICATE OF CORRECTION

PATENT NO. : 5,632,326
DATED : May 27, 1997
INVENTOR(S) : GOUGH

It is certified that error appears in the above-identified patent and that said letters patent is hereby corrected as shown below:

On the title page:

Item [87], correct the PCT Publication Date to read -- October 27, 1994 --.

Column 3, line 43, replace "dioxde" with -- dioxide --.

Column 4, line 32, replace "=" with -- ± --.

Column 5, line 62, replace "283692" with -- 1283692 --.

Signed and Sealed this

Seventh Day of October, 1997

*Attest:*

Bruce Lehman

BRUCE LEHMAN

*Attesting Officer*

*Commissioner of Patents and Trademarks*